US009825378B2

(12) United States Patent
König

(10) Patent No.: US 9,825,378 B2
(45) Date of Patent: Nov. 21, 2017

(54) MOUNTING CLIP

(71) Applicant: DET International Holding Limited, Grand Cayman (KY)

(72) Inventor: Magnus König, Wyhl (DE)

(73) Assignee: DET International Holding Limited, Grand Cayman (KY)

( * ) Notice: Subject to any disclaimer, the term of this patent is extended or adjusted under 35 U.S.C. 154(b) by 0 days.

(21) Appl. No.: 15/090,288

(22) Filed: Apr. 4, 2016

(65) Prior Publication Data

US 2016/0301149 A1 Oct. 13, 2016

(30) Foreign Application Priority Data

Apr. 8, 2015 (EP) ..... 15405027

(51) Int. Cl.

| | |
|---|---|
| ***H01R 13/11*** | (2006.01) |
| ***H01R 12/57*** | (2011.01) |
| ***H01R 4/18*** | (2006.01) |
| ***H01R 4/22*** | (2006.01) |
| ***H01R 11/12*** | (2006.01) |
| ***H01R 43/048*** | (2006.01) |
| ***H01R 9/18*** | (2006.01) |

(52) U.S. Cl.

CPC ..... *H01R 12/57* (2013.01); *H01R 4/183* (2013.01); *H01R 4/22* (2013.01); *H01R 9/18* (2013.01); *H01R 11/12* (2013.01); *H01R 43/0484* (2013.01)

(58) Field of Classification Search

CPC ..... H01R 13/111; H01R 11/12
USPC ..... 439/521, 801, 860, 892; 174/138 F
See application file for complete search history.

(56) References Cited

U.S. PATENT DOCUMENTS 3,090,936 A * 5/1963 Maitby ..... H01R 9/2416 439/595
3,517,370 A * 6/1970 Poingt ..... H01R 13/115 174/138 F
3,605,065 A * 9/1971 Shannon ..... H01R 11/289 429/121
3,777,301 A * 12/1973 Michaels ..... H01R 25/00 439/749
3,960,427 A * 6/1976 Piaget ..... H01R 4/70 174/138 F (Continued)

FOREIGN PATENT DOCUMENTS

EP 0603872 A2 6/1994
JP H0463567 U 5/1992

OTHER PUBLICATIONS

European Search Report for EP application No. 15405027.2, dated Sep. 2, 2015.

*Primary Examiner* — Neil Abrams
(74) *Attorney, Agent, or Firm* — Vector IP Law Group; Robert S. Babayi

(57) ABSTRACT

A mounting clip for connecting a cable terminal of an electrical cable to an electrical unit comprising a receiving portion for one element of a two-element connection system and a groove for receiving at least a part of a cable terminal and/or part of a cable. A nut can be fixedly held in the receiving portion of the clip. A terminal with an opening can be placed between the nut and an electrical unit. A screw can be threaded into the nut to press the terminal against a surface of the electrical unit.

18 Claims, 3 Drawing Sheets

(56) References Cited

U.S. PATENT DOCUMENTS 4,118,097 A * 10/1978 Budnick ..... H01M 2/206 439/387
4,427,257 A * 1/1984 DeMarco ..... H01R 4/70 439/740
4,952,171 A * 8/1990 Sugiyama ..... H01R 11/284 174/138 F
5,073,126 A * 12/1991 Kikuchi ..... H01R 4/245 439/397
5,173,060 A * 12/1992 Shimirak ..... H01R 4/2408 439/416
5,295,860 A * 3/1994 Jozefczyk ..... H01R 27/02 439/503
5,346,408 A * 9/1994 Chupak ..... H01R 11/284 174/138 F
5,380,220 A * 1/1995 Okabe ..... H01R 13/506 439/456
5,413,500 A * 5/1995 Tanaka ..... H01R 4/22 439/521
5,620,338 A * 4/1997 Stephens ..... H01R 11/281 439/522
5,997,341 A * 12/1999 Ushiyama ..... H01R 4/305 439/480
6,153,329 A * 11/2000 Raschilla ..... H01M 2/344 429/65
6,250,975 B1 6/2001 LaPointe
6,428,363 B2 * 8/2002 Tamai ..... H01R 11/282 439/677
6,520,812 B1 * 2/2003 Machado ..... H01R 11/282 439/855
6,533,619 B2 * 3/2003 Wakata ..... H01R 13/642 439/202
7,198,526 B1 * 4/2007 MacNeil ..... H01R 4/185 439/881
7,530,843 B1 * 5/2009 Tesfay ..... H01R 4/183 439/587
8,056,867 B2 * 11/2011 Tan Chin Yaw ..... H01R 13/621 248/49
8,338,710 B2 * 12/2012 Maguire ..... H01R 11/284 174/135
8,466,586 B2 * 6/2013 Tarchinski ..... B60K 6/46 180/65.1
8,562,381 B2 * 10/2013 Kawamura ..... H01R 4/34 439/801
9,466,908 B2 * 10/2016 Ohkubo ..... H01R 13/111
2016/0301149 A1 * 10/2016 Konig ..... H01R 4/183

* cited by examiner

MOUNTING CLIP

TECHNICAL FIELD

The invention is concerned with a mounting clip to be used in a system for establishing an electrical and mechanical connection between a cable and an electrical unit. The mounting clip comprises a receiving portion for one of the elements of a two-element connection system and a groove for receiving at least a part of a cable and/or a part of a cable terminal.

The invention is further related to a cable connection kit for establishing an electrical and mechanical connection between a cable and an electrical unit, which comprises the mounting clip, the two-element connection system and the cable terminal.

Additionally, the invention describes a method to fix a cable to an electrical unit with the cable connection kit.

BACKGROUND OF THE INVENTION

One common possibility to fix a cable to an electrical unit is to solder a connector having a table like shape to the electrical unit. Thereby, the connector is electrically conducting and has an essentially flat surface located in some distance to the electrical unit. Usually such connectors have a hole in the flat surface whereby the hole can optionally have a thread. A cable which is to be fixed to the electrical unit is usually connected to a ring-terminal or a similar type of cable terminal. In order to fix the cable terminal to the connector, the cable terminal can be placed onto the flat surface of the connector and fixed with a screw, either by using the thread in the hole or a nut placed on the opposite side of the flat surface above the electrical unit. Thereby, the ring or equivalent part of the cable terminal is squeezed between the head of the screw and the flat surface of the connector and thus, an electrical connection is established via the cable, the cable terminal, the connector and the electrical unit.

A disadvantage of this system is that it has a certain height. Connectors, rising up above the electrical unit surface and being soldered to it, can be ripped off while mounting or dismounting other elements on the electrical unit. Finally, as cables are in general mounted after placing an electrical unit in its final position, e.g. in a casing, the cables have to be mounted on the top side of the electrical unit. This creates easily a mess and in many cases the cables are an obstacle, if there is work to do on the electrical unit.

There exists further a method of screwing a ring-terminal directly to an electrical unit. While this method avoids the table-shaped connectors, it has the problem that access to the backside of the electrical unit is needed in order to place and hold a nut with the required thread for the screw. This access is often difficult or even impossible to obtain.

Another connection system is presented in US 2013/0303033 (Alltop Electronics). This document discloses a power connector. The system comprises an insulating housing with a plurality of passageways. Power contacts with a U-shape and a width similar to the passageways are inserted and fixed by a screw which passes from a rear cavity of the opposite side of the housing through a small opening into a hole with a thread in the power contacts. There is a terminal module in the rear cavity where cables can be fixed to. In this way, an electrical connection can be established between the cables fixed to the rear cavity and the cables connected to the U-shaped power contacts.

However, this document describes a cable-to-cable connection system. It offers therefore no solution for the question how to connect a cable directly to an electrical unit without the need of an additional cable.

Thus, there is a need to develop alternative and improved methods and systems which overcome the aforementioned drawbacks. More specifically, there is a need for an system for connecting a cable to an electrical unit. Preferably, the system should be as compact as possible and allow for an easy installation and connection of the cable to the electrical unit. Additionally, the system should especially facilitate connecting a cable to an electrical unit in a casing. Preferably, the system also enables a neater wiring.

SUMMARY OF THE INVENTION

Briefly, according to the invention, a mounting clip for connecting a cable terminal of an electrical cable to an electrical unit comprises a receiving portion for one element of a two-element connection system and a groove for receiving at least a part of a cable terminal and/or part of a cable.

An advantage of the invention is that with the help of the mounting clip, a cable can be fixed to the backside of the electrical unit which is difficult to access. The mounting clip allows fixing a first element of the two-element connection system and positions the cable terminal and/or the cable. Therefore, there is no further need to additionally hold and fix one of the elements of the two-element connection system while establishing the connection. There is also no need for a hand or an instrument to position the cable terminal or the cable relative to the two-element connection system as it is already positioned by the mounting clip. The back side of an electrical unit is often difficult to access at the point in the installation process when cables are connected. Therefore, cables are often connected to an easily accessible front side. However, with the help of the mounting clip, the cable can be easily mounted on the back side of the electrical unit, reducing the number of cables on the front side of the electrical unit. As most other pieces and devices have to be mounted on the front side for being accessible, the cables pose little problems on the backside and therefore the cable mess is reduced and/or located in a region where it does not cause any trouble.

The "two-element connection system" comprises the first and the second element. The "fixing axis" is the direction in which the two-element connection system exerts its force. For most two-element connection systems considered here, the principle axis (i.e. the rotational symmetry axis for rotational solids) of the female and the male part of the first respectively the second element is typically identical to the fixing axis in the mounted state.

The "fixing plane" is any one of the planes out of the family defined by the fixing axis being its normal.

In the present context, a two-element connection system is a system out of at least two elements which can be mechanically connected to each other. Especially, the at least two elements are connectable in a way that the distance between them can be diminished. In particular, the connection system is able to stay in this diminished distance once the two elements of the two-element connection system have been connected. Typical examples of a two-element connection system are for example a nut/screw system, a bayonet system, a clip system, e.g. like the one used in cable binders, two magnets or simply two buttons and a thread.

In a connection system comprising more than two elements, the elements can for example be ordered to belong to two groups. Elements belonging to one group can be pre-assembled, so that a two-element connection system results. For example, the system of two buttons and a thread is a two-element connection system with one button being one of the two elements and another button connected to a thread being the other one of the two elements.

A two-element connection system usually has a male and a female element. Especially, if male elements of the two-element connection system are received by the receiving portion of the mounting clip, they extend at least partially through a hole in the electrical unit at which the two-element connection system should be used. On the other hand, the placement of the male elements in the receiving portion may prevent slipping of the electrical unit during the installation. Placing female elements in the receiving portion has the advantage that they usually do not protrude and that they are therefore less likely to cause damages during the installation process.

In this document, the first element is the element which is or will be placed in the receiving portion of the mounting clip. The second element is the other element of a two-element connection system.

BRIEF DESCRIPTION OF THE DRAWINGS

The figures used to explain the preferred embodiment show the following.

The same parts are labelled with the same labels in all figures.

DETAILED DESCRIPTION

Figure 1:
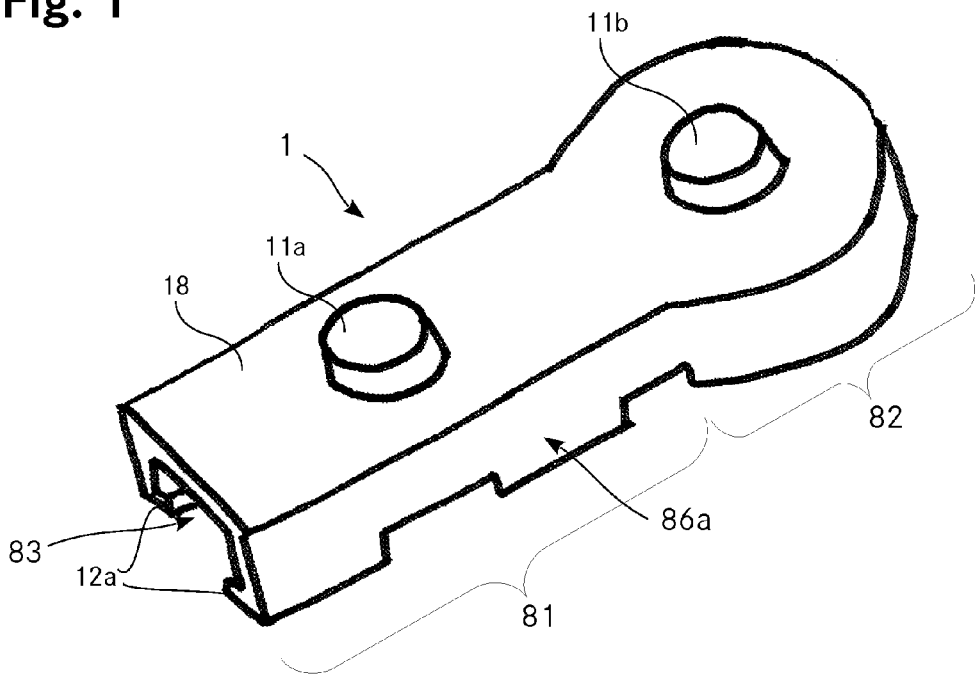
FIG. 1 The bottom side of a mounting clip.

A preferred embodiment of a two-element connection system described herein comprises a nut/screw system. Other examples of such system include a bayonet system, a clip system, e.g. like the one used in cable binders, two magnets or simply two buttons and a thread.

The term "groove" stands in particular for an elongated indentation. Therefore, there is an elongated opening which is called "main opening of the groove" in the following. Opposite of the main opening is the base area or bottom of the groove. According to a preferred embodiment the groove comprises at least one more opening at one end perpendicular to the longitudinal axis of the groove. The term "groove" should be interpreted in a broad sense and also includes indentations with a curved base area. Also, the cross-section of the groove may change along its extension, e.g. along the longitudinal axis.

A cable terminal connects a conductor of the cable with a contact of the electrical unit and/or with at least one of the parts of the two-element connection system. Therefore, it has two different parts: A first part which connects the cable to the cable terminal and a second part which connects the cable terminal with the electrical unit contact. Preferably, the groove is designed such that it can receive the first part of the cable terminal, especially with a cable connected to it, at least partially or completely.

The cable is typically a single conductor cable. If this is not the case, the cable is preferentially divided into its different conductors and each conductor is connected to its own cable terminal then. This splitting can either happen inside a single mounting clip which is suitable for receiving the required number of cable terminals, or the cable can be split up before entering the mounting clip and many single conductor systems can be used, one for each conductor. It is of course also possible to keep conductors unconnected if they are not needed or to combine them.

The "front side of the electrical unit" is typically the side on which the majority of electrical components are mounted. In particular, the front side of the electrical unit is easier accessible after mounting the electrical unit.

The "backside of the electrical unit" is the side opposite of the "front side of the electrical unit".

The "upside of the mounting clip" is the side which will, in the mounted state, face the electrical unit, especially the backside of the electrical unit.

The "downside of the mounting clip" is the side essentially opposite to the upside of the mounting clip.

The "upside plane of the mounting clip" is the plane which is supposed to be placed onto the electrical unit in the mounted state. Preferentially, it can be defined by the three most protruding points on the upside of the mounting clip. In particular, the three most protruding points are not arranged on a straight line. It is therefore the plane in which a plane sheet lays if placed on the upside of the mounting clip.

Heights should be measured along resp. parallel to the fixing axis unless otherwise noted. One special case is found in the definition of the "upside plane of the mounting clip", where the "most protruding points" are not necessarily the highest when measured along to the fixing axis. In this case, the height is preferably measured along the local normal of the electrical unit.

"Up" means coming from the backside of the electrical unit to its front side or from the downside of the mounting clip to its upside. In both cases, the "up" direction is along the fixing axis.

"Down" is the opposite direction to "up".

"Above" means having a greater height; "below" means having a smaller height. The reference point can be arbitrarily chosen.

In a preferred embodiment, there is a fixing device for mechanically fixing the cable terminal and/or cable in the groove.

It is one purpose of the mounting clip to position the cable and/or the cable terminal. The groove by itself and by its shape can fulfill this requirement sufficiently. However, as it is very likely that the cables and therefore the cable terminals connected to them move during the installation of an electrical unit, a firmer fixing of the cable and/or cable terminal to the mounting clip can be advantageous. This can be realised by a fixing device. This fixing device can for example be a clip system, a binder system, a thread, a cap with or without one or more springs or any other suitable fixing device. It is also possible to use an adhesive to fix the cable terminal and/or cable in the groove. It is also possible, to combine the different methods, e.g. to use the clip system together with an adhesive or a thread-based system together with an adhesive.

In a further preferred embodiment, the mounting clip comprises a terminal indentation in which parts of the cable terminal can be placed.

A terminal indentation in which parts of the terminal can be placed can be advantageous, if the groove for the cable does not leave enough space for the cable conductor with the first part of the cable terminal mounted on it. Further, depending on the positioning of the cable and the first element relative to each other and the type and shape of the cable terminal, a terminal indentation for the second part of the cable terminal may be an advantage. Finally, a terminal indentation which surrounds parts, especially the second part, of the cable terminal at least partially can be used to position the cable terminal even more precise.

In a preferred embodiment, there is a terminal indentation for a ring-terminal directly above the receiving portion defining a cylindrical shape, especially a shallow cylindrical shape, with a radius only slightly larger than the outer radius of the second part of the cable terminal. In particular, there is an opening in a cylindrical boundary defining the terminal indention, especially in a region closest to a closed end of the groove. In this way, the second part of the cable terminal can be placed onto a first element being located in the receiving portion and slipping is thus hindered by the shape of the terminal indention in the mounting clip. At the same time, there is no need to bend the cable terminal as the opening in the cylindrical boundary allows a direct and/or even connection to the cable end. Of course there is no need that the cylindrical boundary is continuous. For example, the cylindrical boundary can be discontinuous such as e.g. a small number of cylindrically arranged pins.

In a preferred embodiment, the mounting clip has an electrically insulating surface. Especially, the mounting clip is made in its entirety from an insulating material.

The cable terminal will have, in the connected state, the voltage of the cable conductor. The cable terminal will most likely touch the mounting clip in the installed state. Therefore, if the mounting clip would be everywhere electrically conducting, it would also be on the cable conductor potential. This is usually undesirable: On the one hand, the mounting clip may touch part of the electrical unit and cause an electrical shortcut or unwanted current in this way. On the other hand, in preferred embodiments, the mounting clip is placed in a housing, a heat trap or something similar. Housings and heat traps are often made out of conducting material, but in many cases they should not have an electrical potential other than ground and therefore they are often grounded. A conducting mounting clip would therefore produce a short in such a system.

As an alternative to a complete insulating surface, the mounting clip can only be partly covered with an insulating material. In this case, the mounting clip has for example an insulating surface in regions where the cable conductor and the cable terminal can touch the mounting clip.

In another preferred embodiment, the receiving portion of the mounting clip has a prismatic shape, in particular a hexagonal prismatic shape.

For many two-element connection systems it is necessary or at least advantageous to fix one of the elements, preferentially the first element, against rotation while the second element is connected to it. This fixing can be done by the receiving portion of the mounting clip. A prismatic shape has a certain depth and a cross-section with corners. Placing a fitting or complementary element into an indentation or onto a protrusion of prismatic shape, secures the element against translation in the fixing plane. The corners can stop rotation around the fixing axis provided that the outside or inside cross section of the element has a suitable size and shape. In the case of receiving portion with a hexagonal prismatic shape, a typical nut with hexagonal shape can be placed in such a receiving portion.

There are, however, two-element connection systems, where rotation plays no role. If one of these systems (e.g. a binder like or a buttons-thread system) is used, the receiving portion can have any shape which hinders translational motions in the fixing plane for example have a round or rectangular cylindrical shape.

In all cases, e.g. the cylindrical, the prismatic shape and any other suitable shape, the shapes do not need to be complete. Parts of the walls can be missing as long as there are 3 pins left which are arranged suitably to fix the element.

In another embodiment, the receiving portion of the mounting clip features a rotationally asymmetric shape.

In this application the term "rotationally asymmetric" means that the respective object is not rotationally symmetric.

Receiving portions with rotationally asymmetric shapes can also be used to fix one of the connection elements against rotation. These shapes can also be free of corners.

According to another preferred embodiment, the groove is configured as a stopped groove.

A stopped groove is a groove which is open at one end perpendicular to the longitudinal axis and features a closed end at the other or opposite end. Here, a groove ending inside the receiving portion should also be considered to be a stopped groove. A groove being on one end only partially closed e.g. closed up or down to a certain depth, should also be a stopped groove (the word "end" may be misleading, as this place may be more like an obstacle in a continuing groove).

In a preferred embodiment, a longitudinal axis of the groove is oriented such that it points toward the receiving portion, especially towards a longitudinal axis of the receiving portion.

Using a stopped groove allows to place the receiving portion so that the longitudinal axis of at least a last part of the groove points towards the receiving portion's longitudinal axis. This allows using standard cable terminals. One has a similar advantage if the groove ends in the receiving portion or if the groove crosses the receiving portion. These are further possible embodiments. However, it is more difficult to place the cable end in the required distance from the receiving portion in this case.

If a continuous groove not ending in or crossing the receiving portion is used, the cable terminal is preferably formed suitable to reach from the cable end to the top end opening of the receiving portion. The same is true for stopped grooves which do not point toward the receiving portion. The advantage of these embodiments is the freedom to choose the location and type of the groove.

The "top end opening of the receiving portion" is defined by the highest opening of the receiving portion, if the receiving portion is an indentation. If it is a protrusion, it depends on the shape of the element placed on it. The "top end opening of the receiving portion" is in this case the plane defined by the top part of the head part of the first element in the orientation in which it can be placed on the receiving portion. The head part of the element is the area which transfers a force on the surrounding material if the two-element connection system is tightened with material in between.

In one possible embodiment, the longitudinal axis of the groove and the longitudinal axis of the receiving portion intersect at an angle of 0-90°, in particular 75-90°, especially 90°.

An angle of 90° between the longitudinal axis of the groove and the longitudinal axis of the receiving portion means that the cable runs (locally) parallel to the electrical unit in the mounted state.

An angle of less than 90° guides the cable away from the electrical unit. Having an angle other than 90° between the longitudinal axis of the groove and of the receiving portion requires a bending in the cable terminal. This is due to the fact, that the first part of the cable terminal is connected to the cable which will be placed inside the groove. The second part of the cable terminal however should establish the contact between a contact on the electronic device and/or at least one of the two elements of the two-element connection system. Therefore, the first part of the cable terminal lies along or parallel to the longitudinal axis of the receiving portion while the second part is perpendicular to the longitudinal axis of the receiving portion in the mounted state. As cable terminals are in most cases produced from metal plates and therefore with an angle of 0° between the first and the second part, bending is needed for this kind of cable terminals. This bending can happen during the installation process, while tightening the two-element connection system or during the installation or production of the cable terminal.

In a preferred embodiment, a main opening of the groove and a top end opening of the receiving portion define parallel or identical planes.

If the main opening of the groove and the top end opening of the receiving portion defined identical planes and if the electrical unit is flat in the contact region between mounting clip and unit, the mounting clip can have a larger contact area. This larger contact area allows a stable fixation of the mounting clip on the electrical unit.

If the planes are parallel and separated to each other, there is a gap between a locally flat area of the electrical unit and the mounting clip. This allows an air circulation which may be necessary for cooling.

Also other relations between the planes can be used to allow either a good contact between an electronic unit and the mounting clip or to provide a gap for e.g. cooling between them.

In a further preferred embodiment a bottom of the groove and a bottom end of the receiving portion define parallel or identical planes.

The bottom end of the receiving portion is parallel to the top end opening of it. Therefore, if the bottom of the groove is parallel to the bottom end of the receiving portion, the bottom of the groove is parallel to the top end of the receiving portion. A cable placed inside such a groove in a way that it lays on the bottom of the groove is therefore parallel to the top end of the receiving portion. Depending on the diameter of the cable and the depth of the groove, it is possible to use not-bended cable terminals. This can be standard cable terminals. It is not needed, that the longitudinal axis of the groove is perpendicular to the longitudinal axis of the receiving portion in this case.

If the bottom of the groove and the bottom of the receiving portion do not define parallel or identical planes, there may be means with which the cable is fixed in a suitable plane to allow the use of standard cable terminals.

In particular, a cross-section of the groove, measured perpendicular to its longitudinal axis, is partially such that parts of a cable terminal mounted on a cable and/or the cable touches three sides of the groove when placed in it.

Such an inner shape of the groove guaranties a precise positioning of the cable and/or the cable terminal inside the groove. There is of course not one global, but rather local longitudinal axis in the case of a curved groove.

Preferably, the fixing device is a clip system comprising one or more protrusions extending from the sides of the groove, in particular towards an inner region of the groove.

These protrusions are preferentially made out of a flexible and elastic material. The flexibility of it should be such that the protrusions can be deformed sufficiently to open a gap wide enough for a cable by pushing said cable on the edges of the protrusions by hand and without further tools. The elasticity should be such that the protrusions return to their unstressed positions after pushing a cable past them in the above described way. In particular, the protrusions are large enough that a distance between two protrusions placed on opposite sides of the groove or between a single protrusion an opposite side of the groove is smaller than a diameter of the cable and/or a diameter of the cable terminal. The distance should be measured perpendicular to the (local) longitudinal axis of the groove in a place parallel or identical to one defined by the main opening of the groove.

Instead of being made out of a flexible material, similar protrusions can be made out of a stiff material, meaning a material which cannot be deformed sufficiently to open a gap for a cable by pushing the cable onto the edges of the protrusions by hand. In this case, the shortest distance between two protrusions positioned on opposite sides of the groove has to be larger than the diameter of the cable. Such protrusions are not placed opposite to each other but shifted. In such a case, it is still possible to place a cable with a connected cable terminal on the end in the groove.

In a preferred embodiment, the mounting clip comprises a structural element on an outer side opposite to the receiving portion which is rotationally asymmetric with respect to the longitudinal axis of the receiving portion The structural element can be convex, concave or both. It can be a single pin. It can simply be the lower part of the mounting clip if it is of asymmetric shape with respect to the longitudinal axis of the receiving portion. Pins being part of the structural element can be equipped with barbs or can have indentations. Hooks can also be possible structural elements or parts of it.

Preferably, the longitudinal axis of the receiving portion is parallel or equal to the fixing axis.

Having a rotationally asymmetric structural element on the outside allows blocking the mounting clip against rotation around the fixing axis by placing it in and/or on a complementary structural element. In many cases the final position of the electrical unit in its surrounding, e.g. a housing, is known before the final installation. In such a case, a mounting clip, equipped with the first element and a cable with connected cable terminal, can be placed at the place where the contact of the electrical unit will be once the electrical unit is installed. If the electrical unit is then placed at its final position, a two-element connection system which requires turning two elements with respect to each other can be used even though there is access to only the second element. This is possible because the first element is blocked against rotation around the fixing axis by the mounting clip and the mounting clip itself is blocked against rotation around the fixing axis by its structural element and the complement of it in and/or on which it is placed.

Instead of using a structural element, it is also possible to fix the mounting clip on whatever is below it by e.g. an adhesive, a screw, wires, binders, clips and the like. The mounting clip can have structural features, like e.g. holes of different shapes or rough surfaces, facilitating or allowing such a fixture. It is also possible, to combine different methods, e.g. to use the structural element together with an adhesive or a thread-based system together with an adhesive. It is also possible to use adapters. This could e.g. be a component, like a column or a block, which can be connected on the one side to anything having a defined position relative to the electrical unit at least during the mounting process and which can be connected to a mounting clip on the other side. This "anything having a defined position" is fore example a housing or a heat sink.

However, especially for two-element connection systems which do not require a relative turning motion for tightening an asymmetric structural element can be omitted. Also, another possibility is to use friction between the electrical unit, mounting clip and/or a further object which is contact with the mounting clip as resisting force against the angular momentum created by tightening the two-element connection system.

In a preferred embodiment, the structural element comprises at least two protrusions, especially at least two pins. A pin is a well defined structural element of which it is fairly easy to produce a complement with sufficient precision. A single pin, especially if placed apart from the fixing axis, can avoid turning during the fixing of the two-element connection system around the fixing axis. If a second pin is used, it is possible to prevent any rotation around a pin axis during the installation procedure of the electrical unit prior to fixing the two-element connection systems, too.

Another aspect of the present invention is concerned with a cable connection kit.

A cable connection kit for establishing an electrical and mechanical connection between a cable and an electrical unit comprises a first element and a second element of a two-element connection system, a cable terminal and a mounting clip.

The two-element connection system, the cable terminal and the mounting clip are in particular defined as described above. Further possible embodiments are described below.

Especially, the components of the cable connection kit are designed to be compatible with each other.

To establish the connection, at least a two-element connection system with both elements is needed. A cable terminal could be omitted if the cable conductor itself can be placed with enough precision. However, as the placement of the conductor is difficult to control if a mounting clip is used, the use of a cable terminal is a preferred.

It is preferred that the cable terminal is one of a ring terminal, a fork terminal or a split ring terminal. These are examples of standard cable terminals. Preferentially, the cable terminal comprises a flat area surrounding a hole.

In this preferred embodiment, the second part of the cable terminal has a flat surface and a hole wide enough for passing through at least a portion of the male element of the two-element connection system. A flat surface ensures a large contact area with the contact of the electrical unit. The hole allows a durable and/or defined positioning of the second part, because slipping possibilities are minimized. If a female element is the first element, the hole should be smaller than the female element. If the male element is the first element, the hole should be smaller than the portion of the male element placed below the cable terminal. In the case of a screw being the male element, the portion placed below the cable terminal is the head of the screw. Therefore, the head has to have a greater diameter than the hole in the cable terminal. On the other hand, the thread of the screw is in this case the portion of the male element which should be able to pass through the hole. Therefore, the hole in the cable terminal has to be larger than the thread part of the screw in this case.

The second part can also have a flat surface in a U-shape or it can just be a single flat strip. It is also possible that the cable terminal is formed out of an end section of the wire of the cable itself. Such an end section can e.g. be formed by bending the wire in the desired configuration. However, it is also possible to simply use a straight end section of the cable. Although a second part in a flat configuration gives a large contact area, it is also possible to use a second part with other cross-sections (e.g. round).

The cable terminal can for example be made out of an easily deformable material, in particular so that it adapts to the electrical unit surface once pressed against it.

Ring-terminals are available as standardized of-the-shelf components. They are available in a variety of sizes. The use of standardized components allows favourable prices and facilitates supply management. Fork- and split-ring terminals are equally common.

In a preferred embodiment, the first element is a nut. In this case, in particular, the second element is a screw.

Nut/screw systems are well known, stable two-element connection system which can be reopened. Nuts are widely available in a range of sizes and with many different properties.

A nut is a female element of a two-element connection system. The nut can be made out of an insulating and/or a conducting material. Especially, the nut can at least partially be coated on a surface with an insulating material. Having an electrically insulating nut can help to prevent unwanted currents. However, one may also want to use the two-element connection system as an electrical connection too and in this case, a conducting nut is preferred.

In a further preferred embodiment, the nuts outer shape is at least partially, approximately a hexagonal cylinder.

A nut/screw connection system requires a relative turning motion for fixing. In order for the mounting clip to be able to block a rotational motion by being formed in a suitable way, the outer shape of the first element, which is here assumed to be the nut, has to be rotationally asymmetric around the fixing axis. Many of the standard nuts fulfill this requirement by having at least partially an outer shape in the form of a hexagonal cylinder.

However, in principle other outer shapes are possible as long as they are rotationally asymmetric, in particular at a height at which they have the largest cross-section.

In a preferred embodiment, the second element of the two-element connection system is a screw.

A screw has the advantage that it is an easily available, of-the-shelf part with many different varieties. A screw forms together with a nut a two-element connection system suitable for the system.

The screw can be made out of a conducting and/or an insulating material. Also the screw can at least partially be coated with an insulating material on a surface. The advantage of having a partially or completely conductive two-element connection system is that there can be more electrical contacts between the electrical unit and the cable as one is not restricted to only one cable terminal.

Alternatives to a screw are e.g. male parts of a bayonet system, of a binder-like clip system and of similar systems.

According to another possible embodiment, the first element is a screw and the second element is a nut.

In a preferred embodiment, the screw has a length between 1-d and 1.1 is the sum of the thickness of the electrical unit to be connected at the place of the connection and a depth of the mounting clip at the place where the nut should be placed. This can be the depth of the receiving portion, but it is also possible that there is a fourth indentation in the bottom surface of the receiving portion with a cross section larger than the cross section of the tip of the male part of the two-element connection system. If this is the case, 1 is measured down to the bottom of the fourth indentation. d is a distance between the lowest part of the mounting clip at the place where the nut should be placed and the uppermost end of the thread in the nut.

Considering the situation that a nut is the first element and therefore placed in or on the receiving portion and the cable terminal and the electrical unit are placed on top of it. The screw has to be long enough to reach through the electrical unit and the cable terminal down to the first windings of the thread of the nut. We assume further that the cable terminal is placed in a terminal indentation. Therefore, the thickness of the cable terminal does not play a role as it extends into the mounting clip and the minimum length of the screw is the distance between the lowest point of the receiving portion and the upside of the mounting clip plus the thickness of the electrical unit minus the distance between the lowest part of the nut to the uppermost end of the thread in the nut. (The depth of a fourth indentation is of no importance for the minimum length). However there is also a maximum length of the screw. If it is longer than the electrical unit thickness plus the depth of the mounting clip at the place where the nut should be placed measured from the upside of the mounting clip and if there is no hole in the mounting clip, the screw will push the mounting clip away from the electrical unit.

Considering the situation that the nut is the second element, the screw has to reach through the electrical unit enough to place the nut on it. This means that the minimum length of the screw is the electrical unit thickness plus the distance between the lowest point of the receiving section and the upside of the mounting clip plus the distance between the downside of the nut and the first threads. There is no maximum length restriction in this case.

Analogue length estimations are valid for other connection systems.

In a preferred embodiment, the cable connection kit comprises a mounting clip where the receiving portion is at least partially configured complementary to the first element so that it can receive the first element in a form fitting manner.

The mounting clip should preferably block the first element in many cases against rotation and against translation. This blocking can be realized by different means. Probably the easiest and most stable one is to form an indentation as a receiving portion in the mounting clip. Thus, in particular the receiving portion has, at least in the region where the first element should be blocked, an (inner) cross-section similar to the (outer) cross-section of the first element. These cross-sections can differ by a small amount in their size whereby the receiving portion cross-section has to be larger or equal to the first element cross-section. Both cross-sections are determined in the fixing plane.

It is also possible that the receiving portion comprises for example a protrusion. The protrusion can e.g. be either formed to fix the first element by touching the first element on its outside (outside protrusion) or it can be formed to fit in possible indentations in the first element (inside protrusion). One may think for example of the first element being a cross-head screw and the mounting clip having a protrusion in the form of a bar fitting in one of the bar-shaped indentations of the screw head. This would be an inside protrusion. An example of an outside protrusion could be a pin blocking a wing of a butterfly screw. Also a combination of outside and inside protrusions is possible. A standard nut could for example be blocked against translations by a pin like protrusion in the centre of the nut and by two pins on the outside against rotation.

Depending on the shape of the first element it is possible that the receiving portion has a shape different from a prismatic shape or a shape according to the cross-section of the first element. This is e.g. possible if protrusions or indentations of the receiving portion can block undesired motions of the first element. E.g. in the case of a butterfly nut, the receiving portion in the mounting clip can have the shape of the wingtips.

If a two-element connection system is chosen which requires no rotation for tightening, the mounting clip does not need to prevent rotation of the first element. In such a case, an indentation with an arbitrary cross-section can be chosen as receiving portion as long as the first element fits in it.

In a preferred embodiment, the cable connection kit comprises a mounting clip, where the fixing device is configured such that the cable terminal and/or cable can be mechanically fixed, in particular in a force-fit and/or form-fit manner, when placed in the groove of the mounting clip.

This has the advantage that a possible cable mess can be reduced. Guiding the connected cables in a predefined direction helps to reach this advantage. Also, the cable terminal should preferably be positioned quite precise and robust against forces and movements occurring in a normal installation process of the electrical unit. The cable terminal which is connected to the cable is the part which is most likely moved during installation.

Therefore, the position of the cable terminal with respect to the mounting clip is easier to keep if the cable is fixed with respect to the mounting clip.

The positioning of the cable with respect to the mounting clip can locally be realized by guiding or placing the cable at least partially in the groove of the mounting clip. Thus, in the region where the cable is to be placed, the groove should be large enough to place the cable at least partially in it but small enough that the position and/or direction of the cable is well defined.

Preferentially, the groove is open on two sides. In this way, the cable can be placed inside it along its length. This is done through the main opening of the groove. The cable leaves the mounting clip through a second open side.

Preferentially, the groove has small protrusions (clips) on the upper edge of the main opening. This is one type of fixing system. The protrusions are formed in a way that a force is needed to push the cable along its length inside the groove and also a force is needed to remove it again.

Preferentially the main opening is on the upside of the mounting clip. Preferentially the groove extends along a straight line but not all the way through the mounting clip. However, it is also possible to guide the cable in one or more curves.

The bottom of the groove is preferentially essentially parallel to the top end opening of the receiving portion. However, other orientations are also possible.

Besides a clip system and a special shape of the groove, the fixing system could be realised by binders, threads, wires, adhesives or the like. It is also possible, to combine different methods, e.g. to use the clip system together with an adhesive or a thread-based system together with an adhesive. It is also possible to place a fitting cap, possibly with springs which push the cable into the groove, on the groove.

In a preferred embodiment, the mounting clip is configured such that the cable terminal can be mechanically fixed in the groove such that an end part of the cable terminal overlaps with the receiving portion of the mounting clip.

The cable terminal can be mechanically fixed in the groove either by the fixing system or by being mechanically connected to the cable which is fixed by the fixing system or by both. The end part of the cable terminal which overlaps with the receiving portion of the mounting clip is at least a part of the second part of the cable terminal.

Additionally, the present invention relates to a system comprising a cable connection kit, an electrical unit with a hole, whereby the hole is at least partially surrounded by a conducting material, and a cable.

Thereby, the cable is connected to the cable terminal and placed in or on the mounting clip. The cable terminal is partially placed on a first element, and a second element passes through the hole in the electrical unit and is connected to the first element. The first element pushes the cable terminal onto the electrical unit whereby an electrical contact between the cable and the conducting material is established. The electrical contact is in particular established via the cable terminal and the conducting material surrounding the hole. However, there can be also an additional electrical contact via the cable terminal, the two-element connection system and the conducting material surrounding the hole.

The hole in the electrical unit can be at least partially surrounded by massive conducting material or it can be at least partially surrounded by another material, e.g. an insulating material, in particular featuring a surface layer made from a conducting material. Both possibilities can be mixed: The hole can partially be surrounding by massive conducting material and partially by an insulator coated with a conducting material. Especially, there is no need for having conducting material on all sides of the hole. The conducting material can for example be a small spot. The conducting material can also be a second cable terminal or a similar material which is not a priori fixed to the electrical unit.

Thus, in the present context, "surrounding" means that the conducting material should be located so close to the hole, that in a preferred embodiment, the cable terminal touches it and/or the two-element connection system touches it. Therefore, the conducting material can be on the backside of the electrical unit, close to the hole. It can be on the inner wall of the hole or it can be on the front side of the electrical unit. It can also be on more than one of these places at once.

An alternative to the electrical unit with a hole is an electrical unit with a suitable edge, e.g. in the form of a notch. This edge can be understood as being part of a suitable hole as described above. Therefore, it can be surrounded or being made out of the same materials and it can have the conductive material at the same places as described above for the hole.

Instead of placing the cable with the already installed cable terminal in or on the mounting clip, it is also possible to place first the cable in the mounting clip and connect it then to the cable terminal. The usefulness of this possibility depends on the connection method chosen for the cable-cable terminal connection.

In a preferred embodiment, the electrical unit is flat on a region of the size of the diameter of the two-element connection system. In another preferred embodiment it is flat on a region of the size of the mounting clip. However, curved surfaces are possible too. But a curved surface restricts the choice of the position of the conducting material on the device and it is also more difficult to distribute the clamping forces of the two-element connection system over the surface.

In a further preferred embodiment, the electrical unit is a printed board assembly (PBA).

Printed board assemblies are usually flat. They are often installed in a way that their backside is difficult to access. Further, their contacts are made in the form of spots of conducting material on their front or back side. Therefore, the presented system can be very well and easily used to connect cables to PBAs.

However, any other electrical unit can use the technique as long as this electrical unit has to be connected to a cable at a place where a hole is present or can be made. The technique can also be used if the place where the cable should be connected is at an edge. A special electrical unit could be for example an electric machine where the power cable should be guided below the floor of the machine. In such a case, the mounting clip can be part of the floor on which the machine should be placed e.g. a suitable formed indention in a concrete floor.

In another preferred embodiment, the end part of the cable runs parallel to the electrical unit plane.

The "electrical unit plane" is the tangential plane to the electrical unit to be connected at the point where the connection should be placed.

The "electrical unit normal" is the normal to the "electrical unit plane".

Bending cables in tight curves may damage them and causes forces on the cable terminals. As the main applications for the system are places where the backside of the electrical unit to be connected with the cable is not or only difficult to access, the free space behind the backside of the electrical unit is often limited in the direction of the electrical unit normal. Therefore, the cables have to run essentially parallel to the electrical unit plane in many cases. Connecting them already in this orientation helps to avoid bending the cables in sharp curves. But even if there is enough space to bend the cables in wide curves, connecting them in a way that they run initially parallel to the electrical unit plane helps to organize them.

The mounting clip can also be shaped in a way that the cables run initially in any other angle to the electrical unit plane. This can be archived by tilting the bottom of the groove in the desired way with respect to the upside plane of the mounting clip.

A method to fix a cable to an electrical unit with the cable connection kit comprises the steps of placing the first element in the mounting clip, installing the cable terminal at an end of the cable, placing the end of the cable with the cable terminal in the mounting clip, placing the electrical unit with the hole, at least partially surrounded by conducting material, on the mounting clip, placing the second element through the hole of the device and tightening the connection between the first and the second element so that an electrical contract between the terminal and the conductive material is established. The end of the cable and/or the cable terminal can be fixed to the mounting clip by a fixing system which can be a clip system as described above or it could be a system using binders, threads, wires, adhesives or the like. It is also possible, to combine the different methods, e.g. to use the clip system together with an adhesive or a thread-based system together with an adhesive. This connection method is in particular suitable if the first element is a female part. If the first element is a male part, the method can be performed in a similar manner. In this case, when placing the electrical unit, the first element is simultaneously moved through the hole in the electrical unit. Subsequently, the second element can be placed onto the first element in this case.

In both versions it is possible to e.g. switch the first two steps (placement of the first element and cable terminal—cable installation). Instead of placing the electrical unit on the mounting clip, the mounting clip could be placed on the electrical unit or both could be placed with only a small distance between them.

If the electrical unit has no suitable hole but a suitable edge, e.g. a notch, the element which is moved through the hole is moved along the edge is such a way that it ends up in a position as if the edge would be a part of a circumference of a hole.

In a preferred embodiment, the system is mounted in a way that the first and the second element squeeze the second part of the cable terminal onto the device and establish thereby an electrical contact.

This mounting can simply be realized by placing parts of the electrical unit between one of the two elements and the terminal. When the two-element connection system is tightened in this configuration, all four components, namely the two elements of the two-element connection system, the second part of the cable terminal and the electrical unit are pushed together. If there is an electrically conducting surface on the electrical unit in the region where the second part of the cable terminal or part of the two-element connection system touches it in this configuration, an electrical contact is established. In a preferred embodiment, the electrical unit has a hole through which the fixing axis passes, but it is also possible to place the system at the edge of the electrical unit.

Preferentially, the cable terminal comprises a part which can establish an electrically conducting contact to a conductor of a cable by crimping.

In this case the first part surrounds the cable wire at least partially. The connection between the cable terminal and the wire is then established by crimping. Crimping is a fast and reliable way of connection cables to cable terminals. But other methods like soldering or screwing can be used, too.

In a preferred embodiment, the mounting clip comprises the structural element on the side opposite to the receiving portion which is rotationally asymmetric with respect to the longitudinal axis of the receiving portion. Preferably, the method to fix a cable to an electrical unit comprises further the step of placing the mounting clip in a region of a further body having a complementary shape to the structural element on the side opposite to the receiving portion of the mounting clip.

The further body can e.g. be a housing, a heat sink, the ground, a table on which the electrical unit is to be assembled, another form of mounting platform, another electrical unit or anything which can be placed in a defined distance to the electrical unit, either temporary or for a longer time. By placing a suitable shaped mounting clip on a suitable shaped body, the mounting clip can be precisely positioned without the need for detailed measurements. Further, if the structural element is suitable, a rotation or translation of the mounting clip can be blocked. A similar effect can be reached by fixing the mounting clip to the ground by other means like adhesives, threads, binders, screws, and the like. It is also possible, to combine the different methods, e.g. to use the structural element together with an adhesive or a thread-based system together with an adhesive. However, these methods limit the motion of the mounting clip, and thereby the cable terminal, along the fixing axis direction, too. This motion, however, may be desired if e.g. the system should be installed at a different place (e.g. a work bench) than the final position of the electrical unit (e.g. a housing). This motion reduces also the requirements of a precise placement of mounting clip and electrical unit relative to each other.

Further beneficial embodiments and combinations of features can be derived from the following detail description and the claims.

Ways Of Carrying Out The Invention

FIG. 1 shows a view onto a bottom region of mounting clip (1). Its general outer shape is the one of a rectangular box (81) with a round cylinder (82) added at one of the short sides. The box (81) and the cylinder (82) have the same height. There are two pins (11*a* and 11*b*) on the otherwise flat surface (18). These pins (11*a* and 11*b*) form a structural element which is rotationally asymmetric. Therefore, they can block a rotation in the plane of the flat surface (18) if the mounting clip (1) is placed on a ground or a further object which has two matching indentations. Alternatively, the mounting clip (1) can be fixed with adhesive, threads, binders or screws and the like to the ground or a further object. It is also possible, to combine the different methods, e.g. to use the structural element together with an adhesive or a thread-based system together with an adhesive. The flat surface (18) with the two pins (11*a-b*) is the downside of the mounting clip. In an inner region of the rectangular box (81), a continuous groove is formed (15; cf. FIG. 2). The groove (15) is open at two sides: One of them being the small, open side (83) opposite of the cylinder and the other being the main opening of the groove (85) opposite of the bottom surface (18) with one of the pins (11*a*). The wall thickness of the box (81) is not constant everywhere and the walls do not have everywhere the same height everywhere. There are regions, located along the side walls (86*a-b*) of the box (81) and opposite to each other, where the side wall (86*a-b*) is slightly shorter compared to the adjacent regions. The regions of normal length have, on the top most part, a greater thickness. The increase in thickness extends only to the inside of the box (81). These thicker regions form clips (12*a* and 12*b*). The clips (12*a*) being closest to the small, open side (83) can be seen in FIG. 1. A cable end can be placed inside the box (81) or the groove (15), respectively. The cable ends at the small, closed side (84) and leaves the box (81) resp. the groove (15) via the small, open side (83). It is placed in the box (81) resp. the groove (15) via the main opening of the groove (85) by pushing it past the clip system (12*a*, 12*b*). Alternatively, if another or additional fixing system is used, the cable is fixed to the groove (85) e.g. by binders, threads, wires or by adhesives or by a suitable shape of the groove (85) or the like. It is also possible, to combine the different methods, e.g. to use the clip system (12*a*, 12*b*) together with an adhesive or a thread-based system together with an adhesive.

Figure 2:
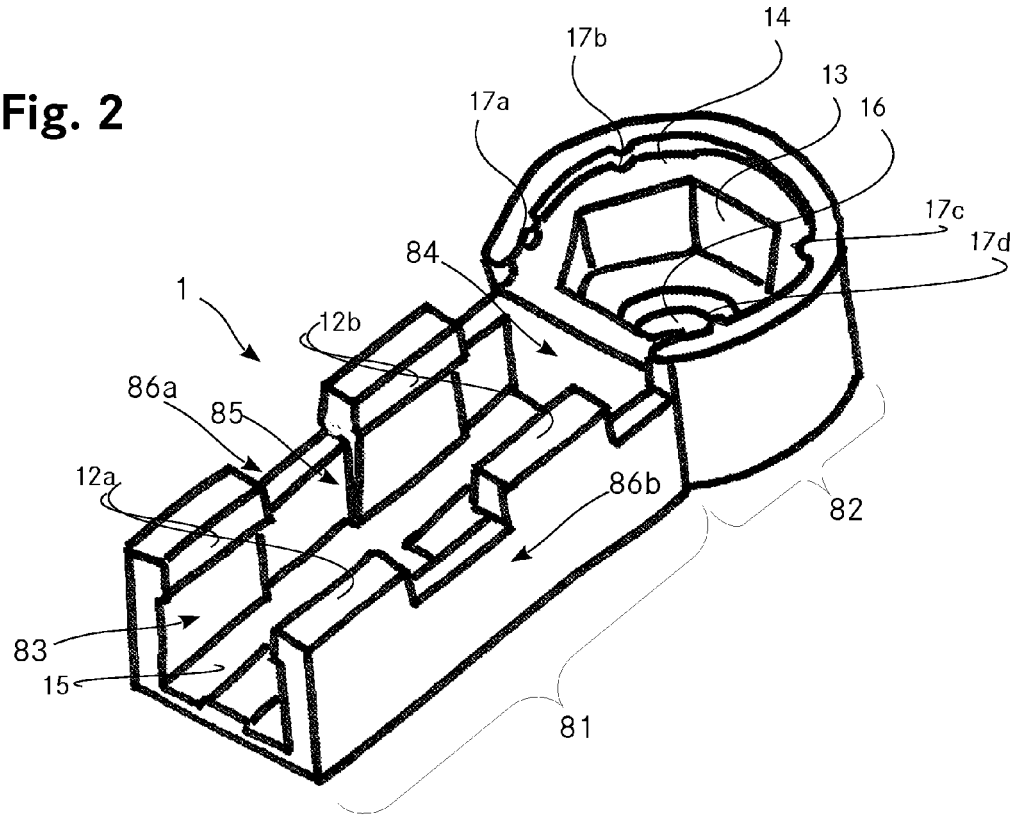
FIG. 2 The upper side of a mounting clip.

FIG. 2 shows the same mounting clip (1) from another perspective. The inside of the box (81) is now visible. The round cylinder part (82) is also partially hollow. There is a receiving portion (13) having a hexagonal cross-section. A nut with a hexagonal cross-section can be placed in there. The inner part of the box (81) forms a groove (15). This is the place where a cable end can be placed. There is a terminal indentation (14) in the upper part of the cylinder (82) having the shape of a circle with a slightly smaller diameter than the cylinder (82). The terminal indentation (14) continues from this circle to the box (81) on a width which is of the same dimension as the width of the opening of the box (81) on its small side (83 or 84). A second part of a cable terminal can be placed in the terminal indentation (14). There can be a further, fourth indentation (16) in the centre of the cylinder with an area being smaller than the hexagonal cross-section of the receiving portion (13). This fourth indentation (16) provides space for the end of a screw and gives therefore more flexibility with regard to the length of the screw. The screw has to have a minimum length such that it reaches the nut when it is placed in the mounting clip and a maximum length such that the tightened screw does not push the mounting clip away. Without the fourth indentation (16) the difference between the largest and the smallest allowed screw length is determined by the nut. With a fourth indentation (16), the screw can extend further into the mounting clip and the interval of possible screw lengths becomes larger. This makes the installation easier and lowers the requirements on a tight placement of mounting clip, ground on which the mounting clip is placed and device.

There can be small protrusions (17*a-d*) in the terminal indentation (14) pointing towards a centre region of the terminal indentation. Such protrusions help to position and fix the cable terminal in the desired position during the mounting process of the system.

Figure 3:
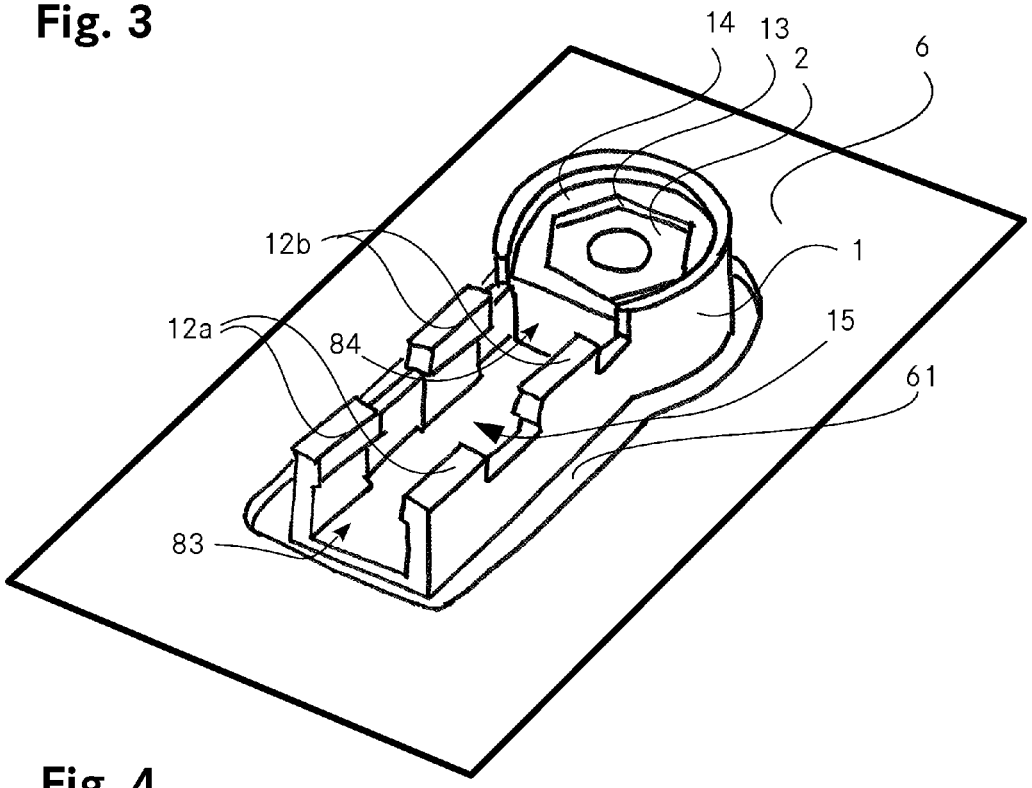
FIG. 3 A mounting clip placed on the ground.

FIG. 3 shows the mounting clip (1) of FIGS. 1 and 2 placed on a support (6). There is a structure (61) in the support (6) which blocks rotation of the mounting clip (1) around an axis normal to the support (6) and which blocks also a translational motion on the support (6). The structure (61) in the support (6) is the complement of the structural element formed by the pins (11*a-b*) on the mounting clip (1). Alternatively, the structure (61) in the support (6) and the structural element of the mounting clip (1) can be omitted and the mounting clip (1) can be fixed with adhesive, threads, binders or screws or the like to the support (6). It is also possible, to combine the different methods, e.g. to use the structure (61)—structural element connections together with an adhesive or a thread-based system together with an adhesive.

A nut (2) is placed in the receiving portion (13). One can see the receiving portion (13) as it is slightly deeper than the height of the nut (2). The groove (15) and the clip system (12*a-b*) are at the same place as in FIG. 2. The same is true for the terminal indentation (14).

The state shown in FIG. 3 is typically the state in the middle of the installation process. The steps realized at this moment are the placing of the nut (2) in the receiving portion (13) of the mounting clip (1) and the placing of the mounting clip (1) on the structure (61) in the support (6). These two steps can be done in an arbitrary order.

Figure 4:
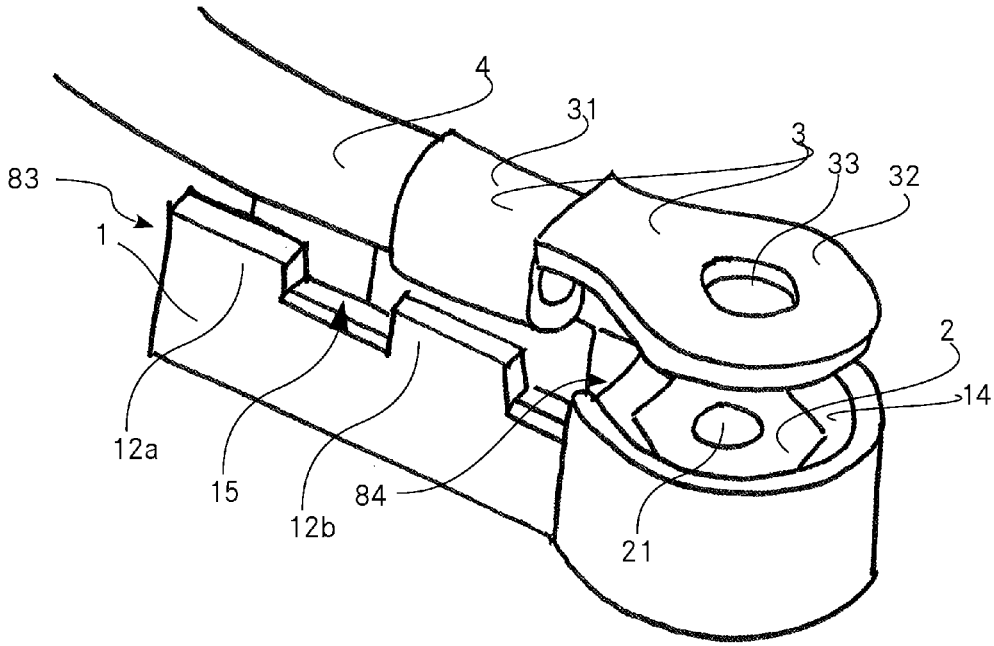
FIG. 4 Placing of a cable with connected cable terminal in the mounting clip.

FIG. 4 shows a cable (4) connected to a cable terminal (3) and a mounting clip (1) with the inserted nut (2). The cable terminal (3) is made in one piece but comprises two regions with different shapes and functions: The first part of the cable terminal (31) which is connected to the cable conductor (not shown) and the second part of the cable terminal (32) which establishes the electrical contact with the electrical unit to which the cable should be connected. The first part of the cable terminal (31) surrounds the cable conductor at least partially and is connected to it by crimping. The second part of the cable terminal (32) is essentially a flat plate with a hole (33). Most of the second part (32) has the shape of a round plate, but there is a connection going off of this round plate to the first part (31). The shape and the dimensions of the cable terminal (3) are such that the second part (32) lies flat in the terminal indentation (14) when the cable (4) is placed in the groove (15). The hole (33) in the second part of the cable terminal (32) is of such a size and positioned in such a way that the hole of the nut (21) is completely open.

FIG. 4 shows the situation before the cable (4) with the cable terminal (3) is placed and fixed in the mounting clip (1). Thereby, the cable terminal (3) is already crimped to the cable (4) and the nut (2) is placed in the mounting clip (1). However, crimping of the cable terminal (3) and placing the nut (2) can be done in arbitrary order. Subsequently, the prepared cable (4) with cable terminal (3) is placed in the mounting clip (1). This placing is done by placing the cable parallel to and over the groove (15) so that the end of the cable is located close to the small, closed side (84) and pushing the cable (3) down into the groove (15) of the mounting clip (1). Alternatively, if another fixing system is used, the cable is fixed to the groove (85) e.g. by binding it to the mounting clip with binders, threads or wires, gluing it to the mounting clip by adhesives or by pushing it into a suitable shape of the groove (85) or the like. If needed, the cable (4) or the mounting clip (1) are moved slightly backwards and forwards (in cable direction) until the second part (32) of the cable terminal (3) is inside the terminal indentation (14) and until the hole in the second part of the cable terminal (33) and in the nut (21) are on top of each other. The clip system (12*a*, 12*b*) keeps the cable inside the groove (15) and the protrusions (17*a-d*) as well as the connection to the fixed cable (4) keep the cable terminal (3) in the terminal indentation (14). At any time between or after these steps, the mounting clip (1) can be placed on the support (6).

Figure 5:
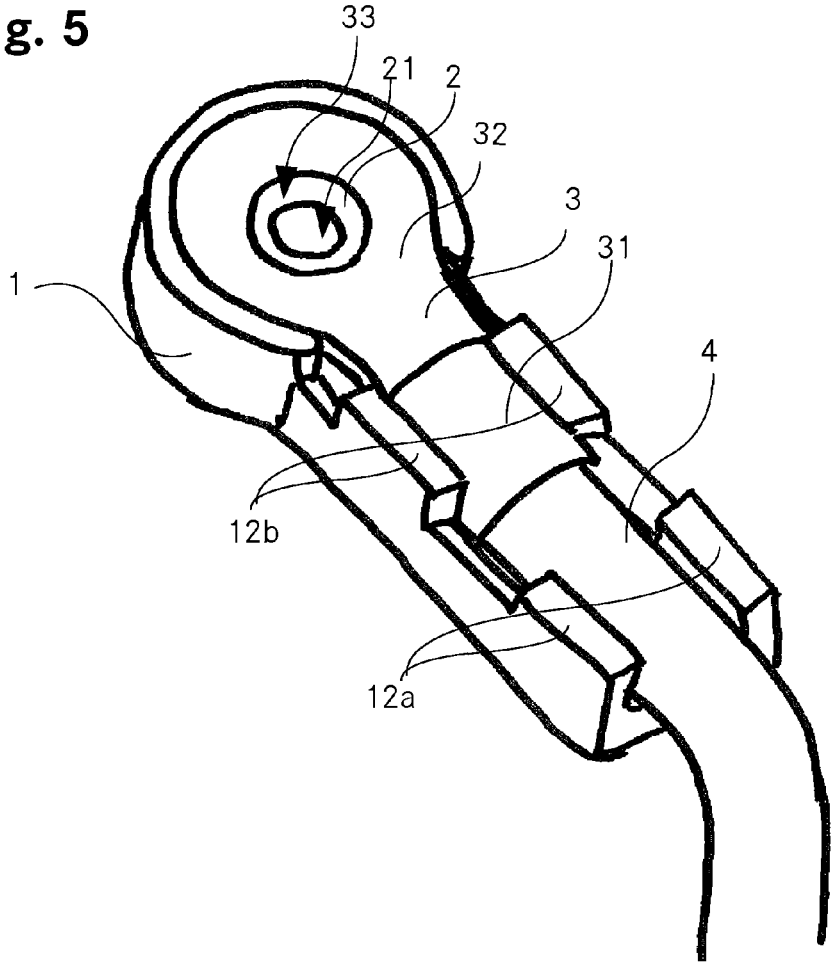
FIG. 5 A mounting clip with a cable placed into it.

FIG. 5 shows the mounting clip (1) with the installed cable (4) on which the cable terminal (3) is mounted. The nut (2) can be seen through the hole (33) in the second part (32) of the cable terminal. The nut (2) has a hole (21), too. The two holes (33, 21) are aligned relative to each other, so that none of them is concealed by the border of the other one. This is important in this embodiment because the screw has to be able reach the thread of the nut (2) which is inside the hole of the nut (21) and the cable terminal (3) should not slip or slide during the mounting process.

The clip system (12*a*) and (12*b*) holds the cable (4) in its place with respect to the mounting clip (1).

Figure 6:
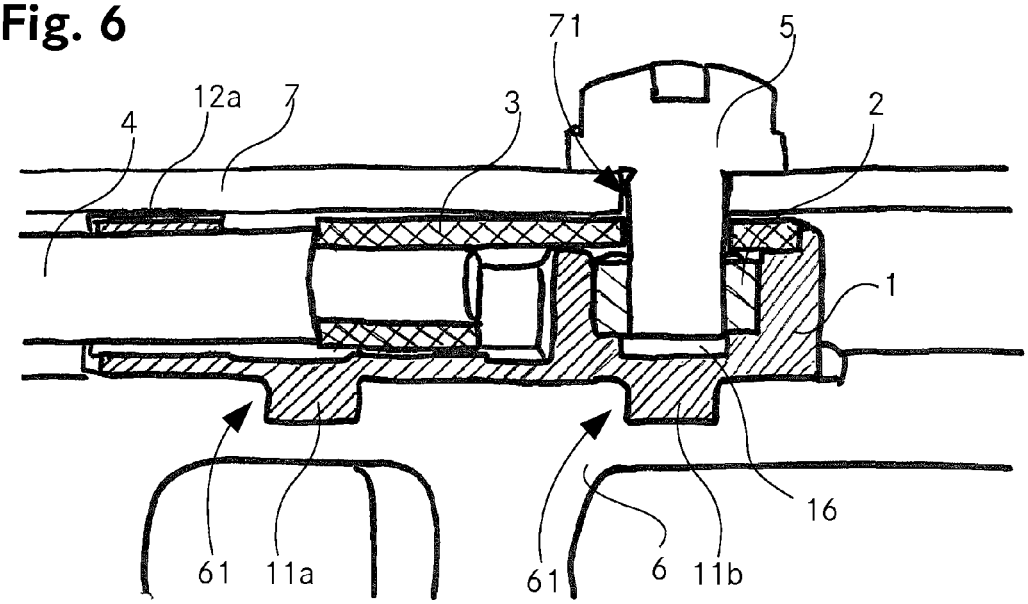
FIG. 6 A cross-section of a system in use.

FIG. 6 shows the mounted system in a cross-sectional view. Besides the mounting clip (1), the cable termination (3), the nut (2) and the cable (4), also the electrical unit (7), the support (6) and the screw (5) are shown.

The pins (11*a-b*) on the bottom side of the mounting clip (1) are placed inside the complementary structure (61) in the support (6). Alternatively, the structure (61) in the support (6) and the structural element of the mounting clip (1) can be omitted and the mounting clip (1) can be fixed with adhesive, threads, binders or screws or the like to the support (6). It is also possible, to combine the different methods, e.g. to use the structure (61)—structural element connections together with an adhesive or a thread-based system together with an adhesive. The support (6) is in this example a heat sink. The cable (4) is placed in the groove (15) and fixed by the clips system (12*a-b*). Alternatively, if another fixing system is used, the cable is fixed to the groove (85) e.g. by binding it to the mounting clip with binders, threads or wires, gluing it to the mounting clip by adhesives or by pushing it into a suitable shape of the groove (85) or the like. It is also possible, to combine the different methods, e.g. fixing the cable (4) with the clip system (12*a-b*) and gluing it to the mounting clip with an adhesive or using a thread-based system together with an adhesive. The cable terminal (3) is crimped on the cable and part of it placed in the terminal indentation above the nut (2). The electrical unit (7) is placed on top of the mounting clip (1). The electrical unit (7) comprises a hole (71). The hole in the electrical unit (71), the hole in the cable terminal (33) and the hole in the nut (21) are aligned. The screw (5) is placed through the holes (71) and (33) and in the hole of the nut (21). As there is a thread on the inside of the hole in the nut (21) and a fitting outside thread on the screw (5), the head of the screw (5) and the nut (2) move toward each other when the screw (5) is turned. The cable terminal (3) is thereby pushed against the electrical unit (7). As the electrical unit (7) comprises an electrically conducting contact area somewhere in the contact region of the second part of the cable terminal (32), an electrical contact is established between the cable (4) and the electrical unit (7). FIG. 6 shows also the fourth indentation (16). In the shown embodiment, the length of the screw (5) is such that the fourth indentation (16) is not needed. However, it is clearly visible that a choice of a slightly longer screw (5) would have led to a situation in which the mounting clip (1) were pushed away from the electrical unit (7) while tightening the screw (5) if the fourth indentation (16) were absent.

The installation processes is, after the placement of the mounting clip (1) including the fixed cable (4), finished by placing the electrical unit (7) on top of the mounting clip (1). After that, the screw (5) is placed and tightened.

Thus, it will be appreciated by those skilled in the art that the present invention can be embodied in other specific forms without departing from the spirit or essential characteristics thereof. The presently disclosed embodiments are therefore considered in all respects to be illustrative and not restricted For example, in a first modification, one or both of the pins (11*a, b*) can be omitted. If the support (6) has e.g. a structure (61) which is the complement of the bottom surface, the irregular shape of the mounting clip (1) is sufficient to block rotation and slipping. It is also possible to fix the mounting clip (1) with adhesive, threads, binders or screws or the like to the support (6). It is also possible, to combine the different methods, e.g. to use the structure (61)—structural element connections together with an adhesive or a thread-based system together with an adhesive. A further structural element, e. g. like the pins (11*a-b*), is not needed in such s situation.

In a $2^{nd}$ modification, instead of or in addition to the pins (11*a, b*) there is another structural element on the bottom surface of the mounting clip. This structural element can comprise additional pins, one or more blocks, one of more lines, one or more edges, one or more irregular shaped objects, and one or more objects with polygonal cylinder shape and the like, as well as any combination of such objects. The structural element can either be an indentation or a protrusion or parts of it can be indentations and parts of it protrusions.

In a $3^{rd}$ modification, the outside shape of the mounting clip (1) is designed differently. It could be for example a cube, a cylinder, a cuboid, a pyramid or another volume. The upper and the lower surface could be tilted with respect to each other. As in the case of a pyramid, there is not even a need for a bottom surface. However there should be an upside surface. The indentations and their position with respect to each other are similar to the ones described in the preferred embodiment.

In a $4^{th}$ modification, the groove (15) for the cable (4) is partially curved and comprises one straight portion just at the small, closed side (84).

In a $5^{th}$ modification, the clip system (12*a, b*) to hold the cable (4) consist of clips on only one side of the groove (15) or of clips which are not opposite of each other but for example in an alternating arrangement. E.g. the clips can be positioned on both sides of the groove (15) at different places along the cable direction.

In a $6^{th}$ modification, there is an angle between plane in which the groove (15) lies and the plane of the surface of the nut (2). In this case, the cable terminal (3) is bent by this angle in between the first part (31) and the second part (32).

In a $7^{th}$ modification, the cable and the cable terminal (3) are connected by soldering or by screws. In an $8^{th}$ modification, there is no cable terminal (3), but the wires of the cable are placed on top of the nut (2). In a $9^{th}$ modification, the cable terminal (3) has a fork type shape or the shape of a single, straight plate or the shape of a hook or another suitable shape.

In a $10^{th}$ modification, the screw (5) is placed, head down, in the first indentation (1). The cable (4) is connected and installed as before, but the cable terminal (3) is placed around the screw (5). The electrical unit (7) is placed on top of the mounting clip (1) so that the screw passes through a hole (71) in the electrical unit. The nut (2) is placed on the screw (5) and tightened.

In an $11^{th}$ modification, the screw (5) and the nut (2) are replaced by parts of a bayonet system, by a clip system as the one known from binders, by a thread or a wire connected to a button which is placed in the receiving portion (13) and which is knotted to another piece. The thread or wire in this last system can also pass the holes twice or more.

Many of these modifications can be combined with each other and with the preferred embodiment.

The invention claimed is:

1. A mounting clip for connecting a cable terminal of an electrical cable to an electrical unit, comprising:

a. a receiving portion for one element of a two-element connection system;

b. a groove for receiving at least a part of a cable terminal and/or part of a cable;

c. a fixing device for mechanically fixing the cable terminal and/or cable in the groove, wherein the fixing device is a clip system comprising flexible protrusions extending from both sides of the groove towards an inner region of the groove, wherein the flexible protrusions are located at an upper edge of a main opening of the groove.

2. The mounting clip according to claim 1 which has an electrically insulating surface.

3. The mounting clip according to claim 1, where the receiving portion has a prismatic shape.

4. The mounting clip according to claim 1, where the groove is configured as a stopped groove.

5. The mounting clip according to claim 1, where a longitudinal axis of the groove is oriented such that it points towards the receiving portion.

6. The mounting clip according to claim 1 which comprises a structural element on a side opposite to the receiving portion which is rotationally asymmetric with respect to a longitudinal axis of the receiving portion.

7. The mounting clip according to claim 1, where the receiving portion has a hexagonal prismatic shape.

8. The mounting clip according to claim 1, where a longitudinal axis of the groove is oriented such that it points towards a longitudinal axis of the receiving portion.

9. The mounting clip according to claim 1 which comprises a structural element on a side opposite to the receiving portion which is rotationally asymmetric with respect to a longitudinal axis of the receiving portion whereby the structural element comprises at least two protrusions.

10. The mounting clip according to claim 1 which comprises a structural element on a side opposite to the receiving portion which is rotationally asymmetric with respect to a longitudinal axis of the receiving portion whereby the structural element comprises at least two pins.

11. A cable connection kit for establishing an electrical and mechanical connection between a cable and an electrical unit comprising:

a) a first element and a second element of a two-element connection system;

b) a cable terminal c) a mounting clip for connecting the cable terminal to an electrical unit, said mounting clip comprising:

i) a receiving portion for one element of a two-element connection system;

ii) a groove for receiving at least a part of the cable terminal and/or part of the cable;

iii) a fixing device for mechanically fixing the cable terminal and/or cable in the groove, wherein the fixing device is a clip system comprising flexible protrusions extending from both sides of the groove towards an inner region of the groove, wherein the flexible protrusions are located at an upper edge of a main opening of the groove.

12. The cable connection kit according to claim 11, where the cable terminal is one of a ring terminal, a fork terminal or a split ring terminal.

13. The cable connection kit according to claim 11, where the first element of the two-element connection system comprises a nut and/or the second element of the two-element connection system comprises a screw.

14. A system comprising:

a. a cable;

b. an electrical unit with a hole;

c. a cable connection kit for establishing an electrical and mechanical connection between the cable and the electrical unit, said cable connection kit comprising:

a first element and a second element of a two-element connection system;

a cable terminal;

a mounting clip for connecting the cable terminal to the electrical unit, said mounting clip comprising:

a receiving portion for one element of the two-element connection system;

a groove for receiving at least a part of the cable terminal and/or part of the cable;

a fixing device for mechanically fixing the cable terminal and/or cable in the groove, wherein the fixing device is a clip system comprising flexible protrusions extending from both sides of the groove towards an inner region of the groove, wherein the flexible protrusions are located at an upper edge of a main opening of the groove, wherein the hole is at least partially surrounded by a conducting material, wherein the cable is connected to the cable terminal and placed in or on the mounting clip, and wherein the cable terminal is partially placed on the first or the second element, and wherein the second element passes through the hole in the electrical unit and is connected to the first element, whereby the first or the second element pushes the cable terminal onto the electrical unit, and whereby an electrical connection between the cable and the conducting material is established.

15. The system according to claim 14 where the electrical unit is a printed board assembly.

16. A method to fix a cable to an electrical unit using a cable connection kit comprising a) a first element and a second element of a two-element connection system;

b) a cable;

c) a cable terminal with a hole;

d) a mounting clip for connecting the cable terminal to an electrical unit, said mounting clip comprising:

i. a receiving portion for one element of a two-element connection system;

ii. a groove for receiving at least a part of a cable terminal and/or part of the cable;

iii. a fixing device for mechanically fixing the cable terminal and/or cable in the groove, wherein the fixing device is a clip system comprising flexible protrusions extending from both sides of the groove towards an inner region of the groove, wherein the flexible protrusions are located at an upper edge of a main opening of the groove, comprising the following steps:

1. placing the first element in the mounting clip;

2. installation of the cable terminal at an end of the cable;

3. placing the end of the cable with the cable terminal in the mounting clip;

4. placing the electrical unit with the hole, which is at least partially surrounded by conducting material, on the mounting clip;

5. placing the second element through the hole of the electrical unit and;

6. tighten the connection between the first and the second element so that an electrical contact between the cable terminal and the conductive material is established.

17. The method according to claim 16, whereby the mounting clip comprises a structural element on a side opposite to the receiving portion which is rotationally asymmetric with respect to a longitudinal axis of the receiving portion and the method further comprises the step of placing the mounting clip in a region of the electrical unit or of a further body having a complementary shape to the structural element on the side opposite to the receiving portion of the mounting clip.

18. A mounting clip for connecting a cable terminal of an electrical cable to an electrical unit, comprising:

a. a receiving portion for one element of a two-element connection system;

b. a groove for receiving at least a part of a cable terminal and/or part of a cable; and c. a clip system configured to removably fix the cable in the groove comprising protrusions extending from sides of a groove towards an inner region of the groove.

* * * * *